US010121333B2

(12) United States Patent
Warren et al.

(10) Patent No.: US 10,121,333 B2
(45) Date of Patent: Nov. 6, 2018

(54) DEVICE WITH PRECISION FREQUENCY STABILIZED AUDIBLE ALARM CIRCUIT

(71) Applicant: Google Inc., Mountain View, CA (US)

(72) Inventors: Daniel Adam Warren, San Francisco, CA (US); Lawrence Frederick Heyl, Mountain View, CA (US); Dietrich Ho, Mountain View, CA (US); Morakinyo John Aina, Mountain View, CA (US); Ian C. Smith, Mountain View, CA (US); William Saperstein, San Carlos, CA (US); Bhaskar Vadathavoor, Cupertino, CA (US)

(73) Assignee: GOOGLE LLC, Mountain View, CA (US)

( * ) Notice: Subject to any disclaimer, the term of this patent is extended or adjusted under 35 U.S.C. 154(b) by 0 days.

(21) Appl. No.: 15/727,059

(22) Filed: Oct. 6, 2017

(65) Prior Publication Data

US 2018/0033258 A1 Feb. 1, 2018

Related U.S. Application Data

(62) Division of application No. 14/985,080, filed on Dec. 30, 2015.

(51) Int. Cl.

| | |
|---|---|
| ***G08B 25/08*** | (2006.01) |
| ***G08B 3/10*** | (2006.01) |
| ***H04R 17/00*** | (2006.01) |

(52) U.S. Cl.

CPC ..... *G08B 3/10* (2013.01); *H04R 17/00* (2013.01)

(58) Field of Classification Search

None

See application file for complete search history.

(56) References Cited

U.S. PATENT DOCUMENTS

| | | | | |
|---|---|---|---|---|
| 3,173,136 | A * | 3/1965 | Atkinson | G08B 3/00 331/47 |
| 3,559,194 | A | 1/1971 | Bisberg | |
| 4,122,365 | A | 10/1978 | Stephens | |
| 5,181,019 | A | 1/1993 | Gottlieb et al. | |
| 5,905,326 | A | 5/1999 | Schnell | |
| 5,990,797 | A | 11/1999 | Zlotchenko et al. | |
| 6,061,455 | A * | 5/2000 | Hadley et al. | 381/57 |
| 6,411,138 | B2 | 6/2002 | Yamakita et al. | |
| 7,528,701 | B2 | 5/2009 | Adelman | |
| 8,023,671 | B2 | 9/2011 | Hou | |
| 8,810,426 | B1 | 8/2014 | Morris | |
| 9,166,544 | B2 * | 10/2015 | Misu | 381/56 |

(Continued)

*Primary Examiner* — Brent Swarthout

(74) *Attorney, Agent, or Firm* — Van Court & Aldridge LLP

(57) ABSTRACT

Systems for ensuring an audible alarm circuit sounds at a minimum magnitude of loudness are provided. Different circuitry embodiments discussed herein are each capable of assisting the audible alarm circuit in maintaining a minimum loudness threshold. Audible alarm circuit operation optimization can be achieved using embodiments that fall within anyone of four general categories: compensation networks, direct drive, dynamic tuning, and microphone feedback based dynamic tuning. Use of such circuitry can increase production yields by compensating for manufacturing variations of alarm components and aging characteristics of the components.

5 Claims, 10 Drawing Sheets

(56) References Cited

U.S. PATENT DOCUMENTS

| | | | | |
|---|---|---|---|---|
| 2007/0223738 | A1* | 9/2007 | North | H03F 1/0211 381/104 |
| 2011/0095896 | A1 | 4/2011 | Lewis et al. | |
| 2013/0076511 | A1* | 3/2013 | Blanc | G10K 9/20 340/540 |

* cited by examiner

DEVICE WITH PRECISION FREQUENCY STABILIZED AUDIBLE ALARM CIRCUIT

This is a divisional of U.S. patent application Ser. No. 14/985,080 filed Dec. 30, 2015, now abandoned, which is incorporated by reference in its entirety for all purposes.

TECHNICAL FIELD

This patent specification relates to systems and methods for maximizing audible output of an audible alarm circuit.

BACKGROUND

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Many devices such as smoke detectors, carbon monoxide detectors, combination smoke and carbon monoxide detectors, security systems, or other systems may sound an alarm for safety and security considerations. The alarm may be sounded by an audible alarm circuit contained in the device. It is desirable for the audible alarm circuit to adequately notify occupants of the alarm. Accordingly, what are needed are systems for ensuring the audible alarm circuit sounds its alarm with a minimum level of loudness.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

Systems for ensuring an audible alarm circuit sounds at a minimum level of loudness are provided. Different circuitry embodiments discussed herein are each capable of assisting the audible alarm circuit in maintaining a minimum loudness threshold. Audible alarm circuit operation optimization can be achieved using embodiments that fall within anyone of four general categories: compensation network, direct drive, dynamic timing, and microphone feedback based dynamic tuning. Use of such circuitry can increase production yields by compensating for manufacturing variations of audible alarm circuits and compensating for aging characteristics that will tend to reduce the alarm loudness.

In one embodiment, a device can include a three terminal piezo-electric buzzer and driver circuitry coupled to the piezo-electric buzzer and operative to drive operation of the piezo-electric buzzer, wherein the operation of the piezo-electric buzzer is characterized by a resonant frequency and buzzer phase. The device can include compensation circuitry coupled to the piezo-electric buzzer and the driver circuitry to complete a circuit loop including the driver circuitry, the piezo-electric buzzer, and the compensation circuitry. The compensation circuitry can be operative to assist the driver circuitry in maintaining the piezo-electric buzzer in a stable oscillation by adding additional phase into the circuit loop to supplement the buzzer phase and to enable the piezo-electric buzzer to operate at, or near, its resonant frequency.

In another embodiment, a device can include a piezo-electric buzzer characterized as having a resonant frequency existing between first and second frequencies, driver circuitry coupled to the piezo-electric buzzer, and a control unit coupled to the driver circuitry and operative to cause the driver circuitry to provide a frequency modulated power signal to the piezo-electric buzzer. The frequency modulated power signal can sweep between the first and second frequencies such that when the modulated power signal is near the resonant frequency, the piezo-electric buzzer emits an audio output.

In yet another embodiment, a maximum resonance driving device is provided. The device can include an electroacoustic transducer, driver circuitry coupled to the transducer, the driver circuitry operative to drive operation of the transducer, control circuitry coupled to the driver circuitry, the control circuitry comprising an adjustable network that can vary output of the driver circuitry, and sense circuitry coupled to an output of the driver circuitry and to the control circuitry. The sense circuitry can be operative to monitor the output of the driver circuitry, and instruct the control circuitry to change a value of its adjustable network based on the monitored output such that the transducer emits an audio signal having at least a minimum magnitude.

In yet another embodiment, a device can include an electroacoustic transducer, driver circuitry coupled to the transducer, the driver circuitry operative to drive operation of the transducer, control circuitry coupled to the driver circuitry, the tuning circuitry comprising an adjustable network that can vary output of the driver circuitry, a microphone, and sense circuitry coupled to the control circuitry and the microphone. The sense circuitry can be operative to monitor an output of the microphone, and instruct the control circuitry to change a value of its adjustable network based on the monitored output of the microphone such that the transducer emits an audio signal having at least a minimum magnitude.

Various refinements of the features noted above may be used in relation to various aspects of the present disclosure. Further features may also be incorporated in these various aspects as well. These refinements and additional features may be used individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

A further understanding of the nature and advantages of the embodiments discussed herein may be realized by reference to the remaining portions of the specification and the drawings.

DETAILED DESCRIPTION OF THE DISCLOSURE

In the following detailed description, for purposes of explanation, numerous specific details are set forth to provide a thorough understanding of the various embodiments. Those of ordinary skill in the art will realize that these various embodiments are illustrative only and are not intended to be limiting in any way. Other embodiments will readily suggest themselves to such skilled persons having the benefit of this disclosure.

In addition, for purposes of clarity, not all of the routine features of the embodiments described herein are shown or described. One of ordinary skill in the art would readily appreciate that in the development of any such actual embodiment, numerous embodiment-specific decisions may be required to achieve specific design objectives. These design objectives will vary from one embodiment to another and from one developer to another. Moreover, it will be appreciated that such a development effort might be complex and time-consuming but would nevertheless be a routine engineering undertaking for those of ordinary skill in the art having the benefit of this disclosure.

It is to be appreciated that while one or more hazard detection embodiments are described further herein in the context of being used in a residential home, such as a single-family residential home, the scope of the present teachings is not so limited. More generally, hazard detection systems are applicable to a wide variety of enclosures such as, for example, duplexes, townhomes, multi-unit apartment buildings, hotels, retail stores, office buildings, and industrial buildings. Further, it is understood that while the terms user, customer, installer, homeowner, occupant, guest, tenant, landlord, repair person, and the like may be used to refer to the person or persons who are interacting with the hazard detector in the context of one or more scenarios described herein, these references are by no means to be considered as limiting the scope of the present teachings with respect to the person or persons who are performing such actions.

Figure 1:
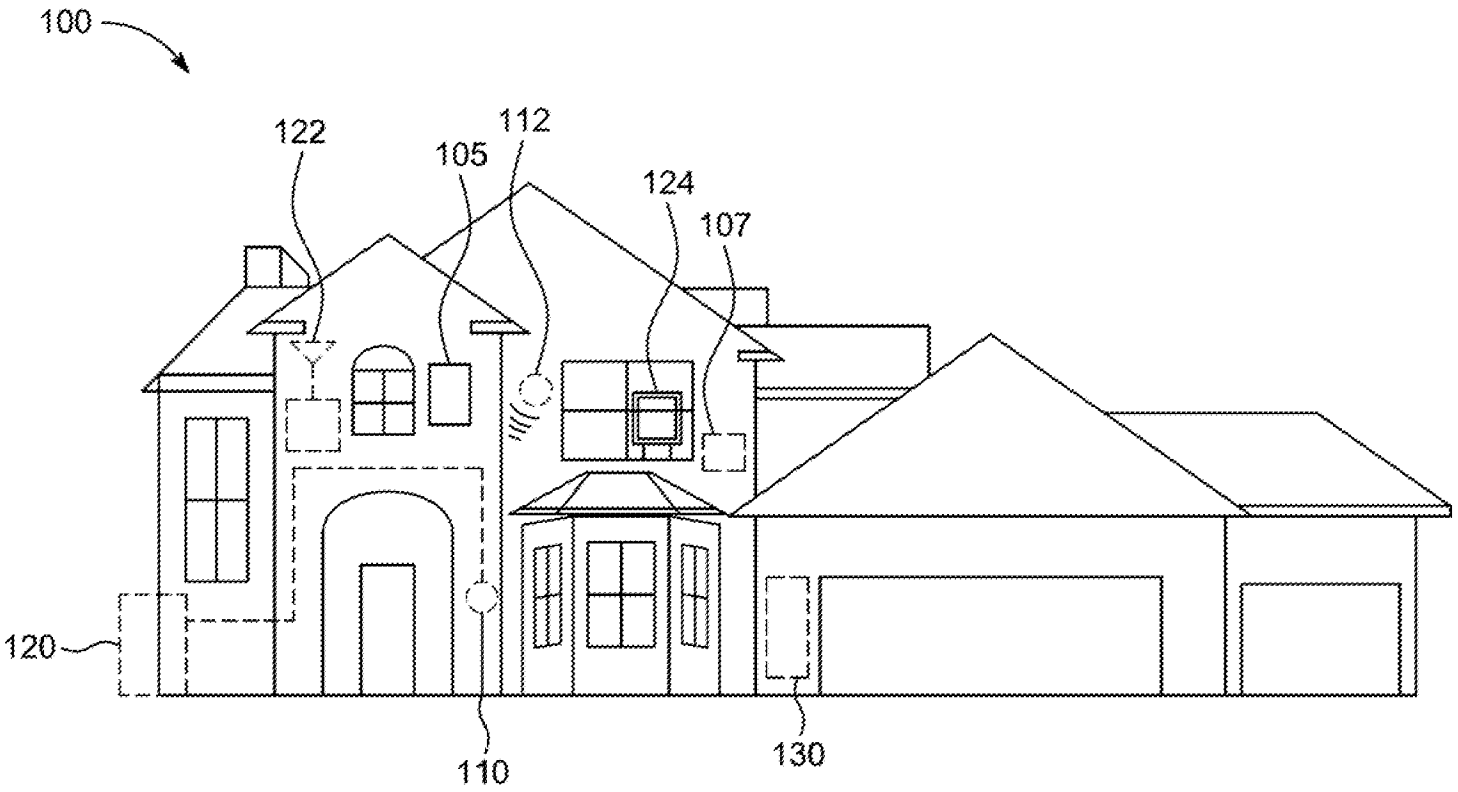
FIG. 1 is a diagram of an enclosure with a hazard detection system, according to some embodiments.

FIG. 1 is a diagram illustrating an exemplary enclosure 100 using hazard detection system 105, remote hazard detection system 107, thermostat 110, remote thermostat 112, heating, cooling, and ventilation (HVAC) system 120, router 122, computer 124, and central panel 130 in accordance with some embodiments. A security system (not shown) can also be included in enclosure 100. The security system can include an audible alarm circuit to sound an alarm. Enclosure 100 can be, for example, a single-family dwelling, a duplex, an apartment within an apartment building, a warehouse, or a commercial structure such as an office or retail store. Hazard detection system 105 can be battery powered, line powered, or line powered with a battery backup. Hazard detection system 105 can include one or more processors, multiple sensors, non-volatile storage, and other circuitry to provide desired safety monitoring and user interface features. Some user interface features may only be available in line powered embodiments due to physical limitations and power constraints. In addition, some features common to both line and battery powered embodiments may be implemented differently. Hazard detection system 105 can include the following components: low power wireless personal area network (6LoWPAN) circuitry, a system processor, a safety processor, non-volatile memory (e.g., Flash), WiFi circuitry, an ambient light sensor (ALS), a smoke sensor, a carbon monoxide (CO) sensor, a temperature sensor, a humidity sensor, a microphone, one or more ultrasonic sensors, a passive infra-red (PIR) sensor, a loudspeaker, one or more light emitting diodes (LED's), and an audible alarm circuit.

Hazard detection system 105 can monitor environmental conditions associated with enclosure 100 and alarm occupants when an environmental condition exceeds a predetermined threshold. The monitored conditions can include, for example, smoke, heat, humidity, carbon monoxide, radon, methane and other gasses. In addition to monitoring the safety of the environment, hazard detection system 105 can provide several user interface features not found in conventional alarm systems. These user interface features can include, for example, vocal alarms, voice setup instructions, cloud communications (e.g. push monitored data to the cloud, or push notifications to a mobile telephone, or receive software updates from the cloud), device-to-device communications (e.g., communicate with other hazard detection systems in the enclosure), visual safety indicators (e.g., display of a green light indicates it is safe and display of a red light indicates danger), tactile and non-tactile input command processing, and software updates.

Hazard detection system 105 can monitor other conditions that are not necessarily tied to hazards, per se, but can be configured to perform a security role. In the security role, system 105 may monitor occupancy (using a motion detector), ambient light, sound, remote conditions provided by remote sensors (door sensors, window sensors, and/or motion sensors). In some embodiments, system 105 can perform both hazard safety and security roles, and in other embodiments, system 105 may perform one of a hazard safety role and a security role.

Hazard detection system 105 can implement multi-criteria state machines according to various embodiments described herein to provide advanced hazard detection and advanced user interface features such as pre-alarms. In addition, the multi-criteria state machines can manage alarming states and pre-alarming states and can include one or more sensor state machines that can control the alarming states and one or more system state machines that control the pre-alarming states. Each state machine can transition among any one of its states based on sensor data values, hush events, and transition conditions. The transition conditions can define how a state machine transitions from one state to another, and ultimately, how hazard detection system 105 operates. Hazard detection system 105 can use a multiple processor arrangement to execute the multi-criteria state machines according to various embodiments. The multiple processor arrangement may enable hazard detection system 105 to manage the alarming and pre-alarming states in a manner that uses minimal power while simultaneously providing failsafe hazard detection and alarm functionalities. Additional details of the various embodiments of hazard detection system 105 are discussed below.

Enclosure 100 can include any number of hazard detection systems. For example, as shown, hazard detection system 107 is another hazard detection system, which may be similar to system 105. In one embodiment, both systems 105 and 107 can be battery powered systems. In another embodiment, system 105 may be line powered, and system 107 may be battery powered. Moreover, a hazard detection system can be installed outside of enclosure 100.

Thermostat 110 can be one of several thermostats that may control HVAC system 120. Thermostat 110 can be referred to as the "primary" thermostat because it may be electrically connected to actuate all or part of an HVAC system, by virtue of an electrical connection to HVAC control wires (e.g. W, G, Y, etc.) leading to HVAC system 120. Thermostat 110 can include one or more sensors to gather data from the environment associated with enclosure 100. For example, a sensor may be used to detect occupancy, temperature, light and other environmental conditions within enclosure 100. Remote thermostat 112 can be referred to as an "auxiliary" thermostat because it may not be electrically connected to actuate HVAC system 120, but it too may include one or more sensors to gather data from the environment associated with enclosure 100 and can transmit data to thermostat 110 via a wired or wireless link. For example, thermostat 112 can wirelessly communicate with and cooperates with thermostat 110 for improved control of HVAC system 120. Thermostat 112 can provide additional temperature data indicative of its location within enclosure 100, provide additional occupancy information, or provide another user interface for the user (e.g., to adjust a temperature set point).

Hazard detection systems 105 and 107 can communicate with thermostat 110 or thermostat 112 via a wired or wireless link. For example, hazard detection system 105 can wirelessly transmit its monitored data (e.g., temperature and occupancy detection data) to thermostat 110 so that it is provided with additional data to make better informed decisions in controlling HVAC system 120. Moreover, in some embodiments, data may be transmitted from one or more of thermostats 110 and 112 to one or more of hazard detections systems 105 and 107 via a wired or wireless link (e.g., the fabric network).

Central panel 130 can be part of a security system or other master control system of enclosure 100. For example, central panel 130 may be a security system that may monitor windows and doors for break-ins, and monitor data provided by motion sensors. In some embodiments, central panel 130 can also communicate with one or more of thermostats 110 and 112 and hazard detection systems 105 and 107. Central panel 130 may perform these communications via wired link, wireless link (e.g., the fabric network), or a combination thereof. For example, if smoke is detected by hazard detection system 105, central panel 130 can be alerted to the presence of smoke and make the appropriate notification, such as displaying an indicator that a particular zone within enclosure 100 is experiencing a hazard condition.

Enclosure 100 may further include a private network accessible both wirelessly and through wired connections and may also be referred to as a Local Area Network or LAN. Network devices on the private network can include hazard detection systems 105 and 107, thermostats 110 and 112, computer 124, and central panel 130. In one embodiment, the private network is implemented using router 122, which can provide routing, wireless access point functionality, firewall and multiple wired connection ports for connecting to various wired network devices, such as computer 124. Wireless communications between router 122 and networked devices can be performed using an 802.11 protocol. Router 122 can further provide network devices access to a public network, such as the Internet or the Cloud, through a cable-modem, DSL modem and an Internet service provider or provider of other public network services. Public networks like the Internet are sometimes referred to as a Wide-Area Network or WAN.

Access to the Internet, for example, may enable networked devices such as system 105 or thermostat 110 to communicate with a device or server remote to enclosure 100. The remote server or remote device can host an account management program that manages various networked devices contained within enclosure 100. For example, in the context of hazard detection systems according to embodiments discussed herein, system 105 can periodically upload data to the remote server via router 122. In addition, if a hazard event is detected, the remote server or remote device can be notified of the event after system 105 communicates the notice via router 122. Similarly, system 105 can receive data (e.g., commands or software updates) from the account management program via router 122.

Hazard detection system 105 can operate in one of several different power consumption modes. Each mode can be characterized by the features performed by system 105 and the configuration of system 105 to consume different amounts of power. Each power consumption mode corresponds to a quantity of power consumed by hazard detection system 105, and the quantity of power consumed can range from a lowest quantity to a highest quantity. One of the power consumption modes corresponds to the lowest quantity of power consumption, and another power consumption mode corresponds to the highest quantity of power consumption, and all other power consumption modes fall somewhere between the lowest and the highest quantities of power consumption. Examples of power consumption modes can include an Idle mode, a Log Update mode, a Software Update mode, an Alarm mode, a Pre-Alarm mode, a Hush mode, and a Night Light mode. These power consumption modes are merely illustrative and are not meant to be limiting. Additional or fewer power consumption modes may exist. Moreover, any definitional characterization of the different modes described herein is not meant to be all inclusive, but rather, is meant to provide a general context of each mode.

Some systems such as hazard detection system 105, remote hazard detection system 107, and a security system may include one or more alarms. The alarm can audibly produce a sound to alert the presence of an urgent condition such as a fire alarm, CO alarm, or intruder alert alarm. The alarm may be an electroacoustic transducer, which may be embodied as one or more of piezo-electric buzzers, electromechanical buzzers, loudspeakers, or any combination thereof. Depending on the alarm configuration, sounds may be emitted at different frequencies. For example, in one embodiment, a first alarm may emit sound at a first frequency (e.g., 3 kHz) and a second alarm may emit sound at a second frequency (e.g., 520 Hz). During an alarming event, for example, both alarms may take turns sounding their respective alarms. For example, the first alarm may sound for a first interval, during which time, it may sound continuously or intermittently, and after the first interval ends, the second alarm may sound for a second interval. During the second interval, the second alarm may sound continuously or intermittently. In some embodiments, only one alarm may be provided that sounds at a desired frequency (e.g., 520 Hz or 3 kHz).

Piezo buzzers use the inverse piezoelectric principle to create movement of a disk to produce sound waves. Optimal sound is produced when the piezo buzzer operates at its resonant frequency. There are several configurations for operating a piezoelectric buzzer to provide audible feedback to a user in an alarm situation. The piezo buzzer provides a high sound pressure level output. The embodiments discussed herein are not limited to the use of solely narrow band piezoelectric transducers, but may also be used with conventional electromechanical loudspeakers. The potential mix of piezoelectric and electromechanical transducers allows embodiments discussed herein to be used over a wide bandwidth, including both the band of peak acoustic sensitivity of the human ear of 3.0-3.5 kHz, and the band for posting an alarm that will require waking the user, which is understood to be centered on 520 Hz.

Although piezo buzzers are suitable for use in alarming systems, they are not without issues—issues that are addressed by embodiments discussed herein. First, the piezoelectric buzzer requires a coincidence of its electrical and acoustical resonances to provide a high sound pressure level output in accord with UL217 or other safety requirement. In a circuit configuration that uses the piezoelectric buzzer in an oscillator configuration, compensation of the oscillator is required to assure stable oscillator start up and oscillator entrainment at the peak output frequency. This requirement can be assured by various types of compensation networks. These compensation networks address different properties of the oscillator. In a circuitry configuration that uses the piezoelectric buzzer as an amplifier, dedicated driving circuitry is required to cause the buzzer to be excited to a high sound pressure level output without special tuning or testing.

A further problem addressed by embodiments discussed herein is the relatively wide operating range of an electroacoustic transducer. For example, in the case of a piezoelectric buzzer, the resonance frequency of a good quality, functional part can vary +/−7%. This can require tuning of the unit or suffering manufacturing loss, both situations addressed by embodiments discussed herein.

Buzzer operation optimization can be achieved using embodiments that fall within anyone of four general categories: compensation network, direct drive, dynamic tuning, and microphone feedback based dynamic tuning. These categories can be further associated with using feedback networks to enable the buzzer to operate at its peak output frequency and driving the buzzer to operate at the peak output frequency. The feedback networks can be implemented electrically or acoustically. Examples of electrical embodiments can include a phase shift or compensation network, direct sequence modulation generated using digital or analog methods, and current/voltage sensing used in a manner opposite to speaker protection. In an acoustic network, microphone sensing can be used. Examples of driving the buzzer can include an electrical feedback phase shift network that is dynamically tunable or fixed, and driving with a proscribed waveform with specific characteristics to achieve the maximum sound output from the buzzer.

In the oscillatory configuration, compensation networks are used to realize a stable oscillation. This can be achieved by adding additional phase compensation to a feedback loop. Different configurations can be used to address different problems. The different configurations can be referred to as 1RC, 2RC, and 4R2C. In the 1RC configuration, a single RC pole is added to force the circuit to oscillate in the high output regime of the piezoelectric buzzer. The 1RC configuration requires that a significant phase shift is realized in the 1RC network, which may be acceptable in some applications. Adding an additional phase shift and realizing a pair of cascaded real poles in a 2RC configuration allows relaxation of the phase shift requirement by each individual RC section. Further extension of the operating bandwidth of the oscillator may be realized by adding two real zeros to the two cascaded real poles, giving a 4R2C configuration. These different networks allow optimization of a specific oscillator to achieve start up and stable oscillation over the band of frequencies that are part of the normal production variation in the transducer. This allows an increased manufacturing yield and simpler component qualification procedures. Compensation networks are discussed in more detail below in connection with the description associated with FIGS. 2, and 4A-C.

In what may be called the amplifying, or direct drive application, the transducer is used as a reconstruction filter for a digital excitation. This allows any transducer response to be excited to a high sound pressure level output without special tuning or testing. This may be implemented in a number of ways. In one embodiment, the transducer is excited by a voltage that is switched between a supply voltage and common. This may also be readily extended to a balanced drive configuration such that for a transducer with two electrodes, the electrodes are switched between supply and common on one electrode, and common and supply on the second electrode. This particular scheme is advantageous as it nominally doubles the mechanical deflection of the transducer and therefore the sound output. The excitation performing the switching may be conceived in several ways. The simplest case is to use a square wave excitation in which the period of the high state and low state of the square wave is modulated as a function of time. As an example, a square wave that is swept from 3.0 kHz to 3.5 kHz in 16 equally spaced steps with a stepping rate of 2.5 mS/step provides a nominally constant sound pressure level output largely independent of the transducer used. This takes advantage of the fact that the transducer resonance frequency varies part by part over a narrow range, and rather than trying to excite a particular response, as this technique sweeps through a great many, if not all possible responses. In this fashion, a sampled analog signal may be applied to the transducer, and the transducer provides the needed reconstruction filtering function. In yet another embodiment, a two-level pulse signal computed by means of noise shaping techniques may be applied to the transducer, allowing generation of a sound output over the power bandwidth of the transducer as desired. Driver circuitry embodiments are discussed in more detail below in connection the description associated with FIGS. 5-6.

In dynamic tuning embodiments, control circuitry may provide a self-adjusting load to tune the resonance of the piezoelectric buzzer in real-time. The control circuitry may operate in a manner similar to NFC radio antenna matching. Dynamic tuning embodiments are discussed in more detail below in connection with the description associated with FIGS. 7-8.

In microphone feedback based dynamic tuning, a microphone can be used to capture the sound output of the piezo buzzer and use that feedback to select an appropriate compensation circuit. Such embodiments are discussed in more detail below in connection with the description associated with FIG. 9. Microphone feedback can also be used in a direct drive application. In this configuration, the direct drive sweeps through a range of frequencies and the microphone monitors the buzzer output to locate a maximum sound pressure level within that frequency range. When the maximum sound pressure level is located, the direct drive can continue to drive the buzzer at the frequency that results in the maximum sound pressure level. A perturb and observe control methodology or other control scheme can be used to stay at peak sound pressure level.

Figure 2:
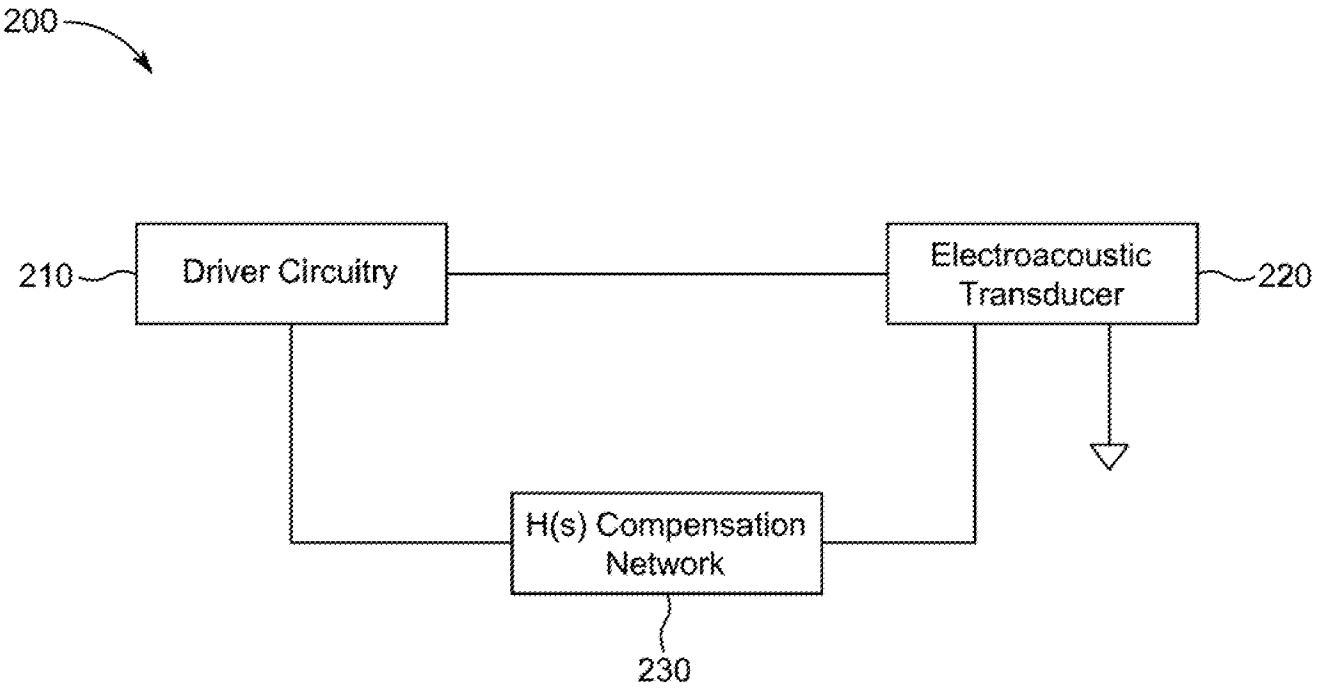
FIG. 2 shows an illustrative schematic diagram of oscillation mode audible alarm device, according to an embodiment.

FIG. 2 shows an illustrative schematic diagram of oscillation mode buzzer device 200, according to an embodiment. Device 200 can include oscillator circuitry 210, electroacoustic transducer 220, and H(s) compensation network 230. As shown, driver circuitry 210 can be coupled to transducer 220 and compensation network 230. Buzzer 220 can be coupled to ground and to compensation network 230. Driver circuitry 210 may serve as a driver that provides drive signals to transducer 220 (e.g., a piezoelectric buzzer). Compensation network 230 serves as feedback coupling transducer 220 to driver circuitry 210. The presence of the feedback provides a loop that must meet two criteria for oscillation. A first criterion must be −180° loop phase and a second criterion must require a gain magnitude of 1 around the loop. Satisfaction of these criteria results in a stable oscillation. Compensation network 230 is operative to ensure that these criteria are met, thereby guaranteeing that transducer 220 starts and maintains steady buzzer output.

Figure 3:
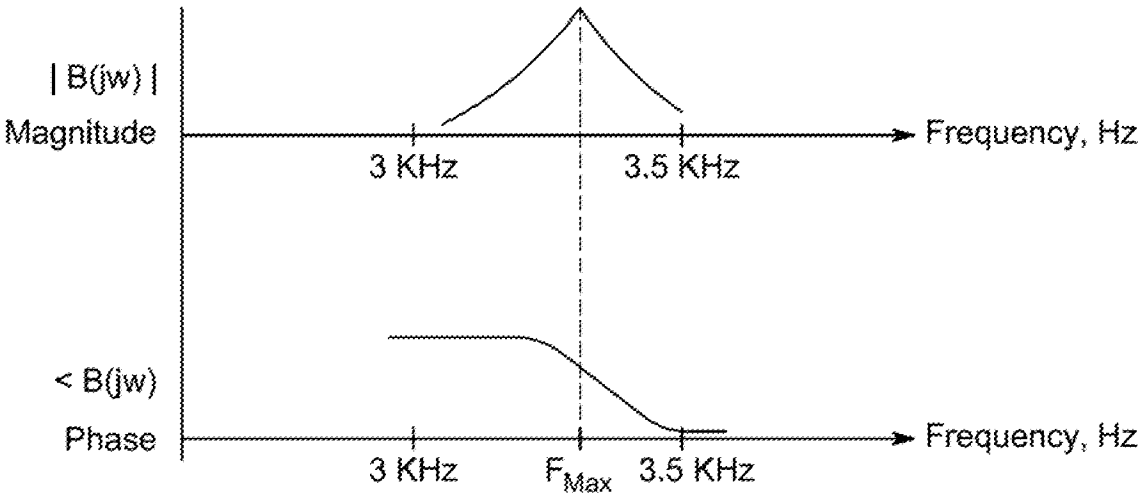
FIG. 3 shows illustrative audible alarm device magnitude and phase response with respect to frequency according to an embodiment.

FIG. 3 shows illustrative magnitude and phase response with respect to frequency of a piezoelectric buzzer according to an embodiment. These frequency response diagrams are illustrative of a typical buzzer response on the domain of 3 kHz to 3.5 kHz. These frequency ranges are merely illustrative and it should be appreciated that any other suitable frequency range may be used such as, for example, 520 Hz. Magnitude is shown as the absolute value of $B(j\omega)$ and phase is shown as the angle of $B(j\omega)$. Each piezoelectric buzzer exhibits a unique maximum magnitude within its frequency range of operation, and each buzzer operates according to a particular phase. It is desirable to drive the buzzer at its maximum magnitude, which occurs at its resonant frequency. Knowledge of the buzzer's maximum magnitude (or resonant frequency) and the phase of the buzzer at that amplitude, defines how much phase the compensation circuitry 230 has to add to the loop to achieve the desired phase shift to satisfy the criteria for maintaining stable oscillation. For example, in FIG. 3, the maximum magnitude occurs at Fmax. Compensation circuitry 230 can provide the necessary phase adjustment (e.g., adds −180 plus the phase shift at Fmax) to ensure that buzzer 220 operates at, or near, its maximum magnitude.

Figure 4A:
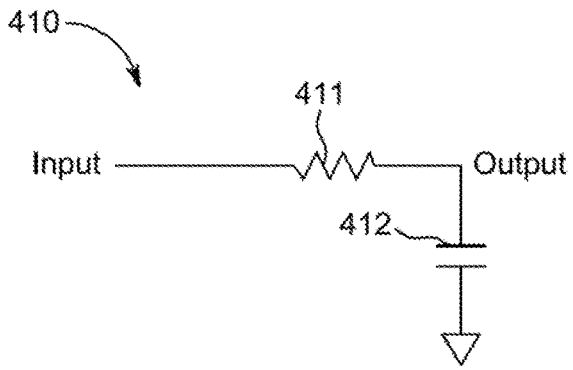
FIGS. 4A-4C show different illustrative compensation networks that can be used in accordance with various embodiments.
Figure 4B:
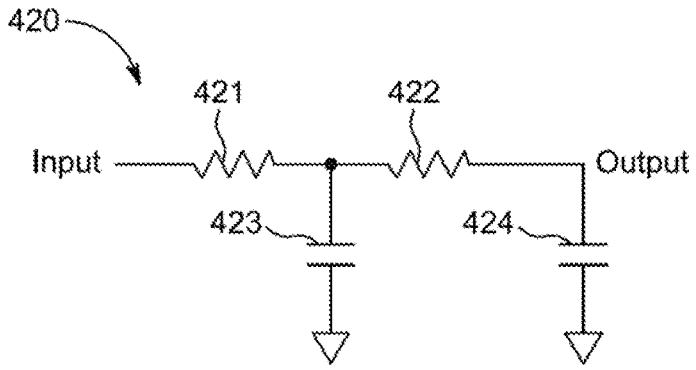
Figure 4C:
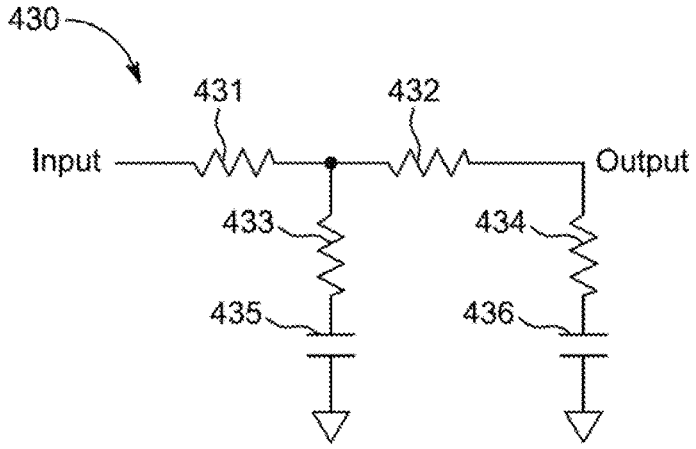

Thus, depending on the magnitude and phase response of a buzzer, an appropriate compensation network can be chosen to ensure that the buzzer operates at or near its resonance frequency. Compensation network 230 can embody any one of a plurality of different configurations. FIGS. 4A-4C show different illustrative compensation networks that can be used in accordance with various embodiments. FIG. 4A shows a 1-RC compensation network 410 that can include resistor 411 and capacitor 412. FIG. 4B shows a 2-RC compensation network 420 that includes resistors 421 and 422, and capacitors 423 and 424 arranged as shown. FIG. 4C shows a 4R-2C compensation network 430 that includes resistors 431-434 and capacitors 435 and 436 arranged as shown. Each of networks 410, 420, and 430 exhibit different characteristics in the manner in which they add phase compensation. For example, network 410 may exhibit a steeper compensation curve than networks 420 and 430.

It should be appreciated that each buzzer may exhibit different magnitude and phase characteristics. That is, the frequency at which one buzzer operates at its maximum magnitude may be different than another buzzer. In addition, even if both buzzers have a maximum amplitude at the same frequency, they may have different phases. This presents manufacturing challenges because even if one particular compensation network works well with a first buzzer, it may not necessarily work as well for another buzzer. Thus, compensation network 230 may be designed based on a sample set of buzzers such that the network sufficiently enables the buzzers to operate within an acceptable range of performance.

Figure 5:
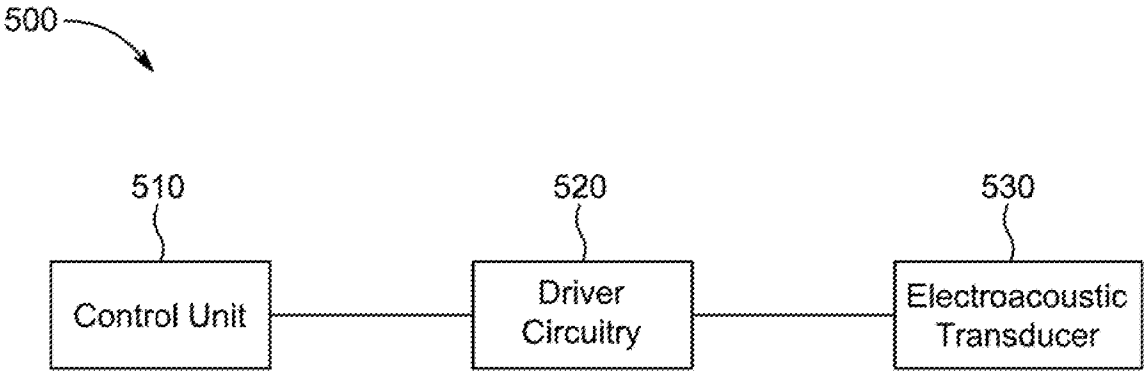
FIG. 5 shows an illustrative block diagram of a direct drive electroacoustic transducer system according to an embodiment.

FIG. 5 shows an illustrative block diagram of direct drive buzzer system 500 according to an embodiment. System 500 can include control unit 510, driver circuitry 520, and electroacoustic transducer 530. Electroacoustic transducer 530 can be a piezo-electric buzzer set up in a two-terminal configuration where no feedback is provided. Driver circuitry 520 can be operative to provide a signal (e.g., a power signal) that drives electroacoustic transducer 530. Control unit 510 may modulate the output of driver circuitry 520 to control a frequency modulation of a signal provided to electroacoustic transducer 530. For example, control unit 510 can generate a pulse code modulation waveform or a pulse density modulation waveform. By controlling the frequency modulation of the signal provided to electroacoustic transducer 530, control unit 510 can effectively ensure that electroacoustic transducer 530 operates at a sufficient magnitude regardless of the optimal resonance frequency of the electroacoustic transducer. For example, as mentioned above, piezo-electric buzzers may have different resonance frequencies. As a specific example, one buzzer may have a resonant frequency at 3.1 kHz and another buzzer may have a resonant frequency at 3.3 kHz. Control unit 510 may cause driver circuitry 520 to sweep through a range of frequencies when driving electroacoustic transducer 530. This way, the 3.1 kHz buzzer sounds at a maximum loudness when it receives a signal operating at or near 3.1 kHz and the 3.3 kHz buzzer sounds at a maximum loudness when it receives a signal operating at or near 3.3 kHz. The characteristics of the modulated signal provided to electroacoustic transducer 530 can vary, examples of which are now discussed.

Figure 6A:
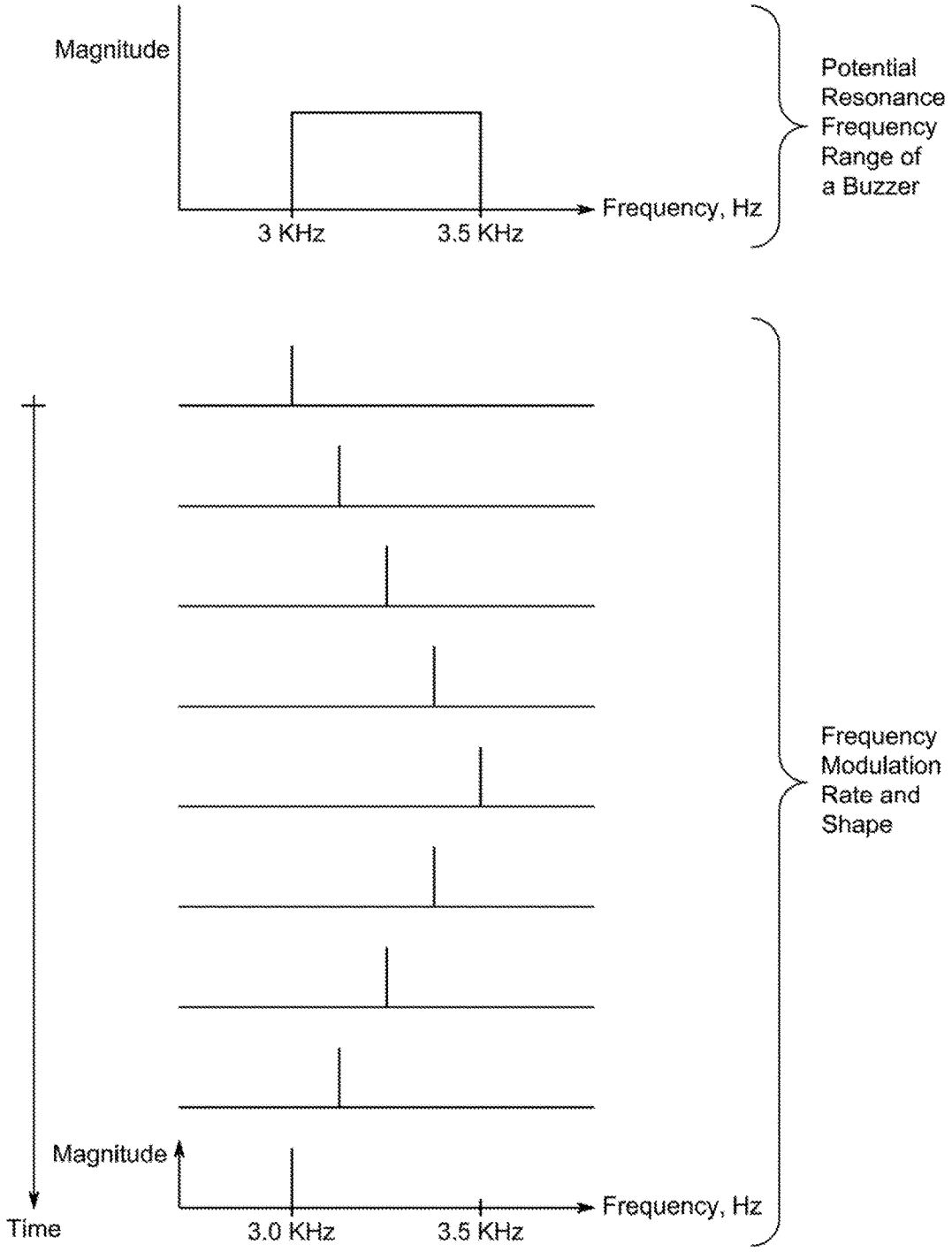
FIGS. 6A and 6B show illustrative frequency modulation schemes provided by a control unit, according to an embodiment.

FIG. 6A shows an illustrative frequency modulation scheme provided by control unit 510, according to an embodiment. As illustrated, FIG. 6A shows that the potential resonance frequency of a piezo-electric buzzer can fall within a range (e.g., 3 kHz to 3.5 kHz). FIG. 6A also shows an illustrative frequency modulation of a signal applied to the buzzer. As shown, the frequency modulation exhibits a modulation profile as the signal moves across the potential resonance frequencies. As shown, this shape exhibits a sinusoidal or triangular shape, but can exhibit any suitable design. In addition to the profile, the rate of frequency modulation across the range of potential resonance frequencies may be controlled. The rate can be selected to strike a balance between maximum energy output of the piezo-electric buzzer and a time delay between each successive maximum sound output event. For example, in one embodiment, the rate of frequency modulation can be about 28 Hz for buzzers operating between 3 kHz and 3.5 kHz.

Figure 6B:
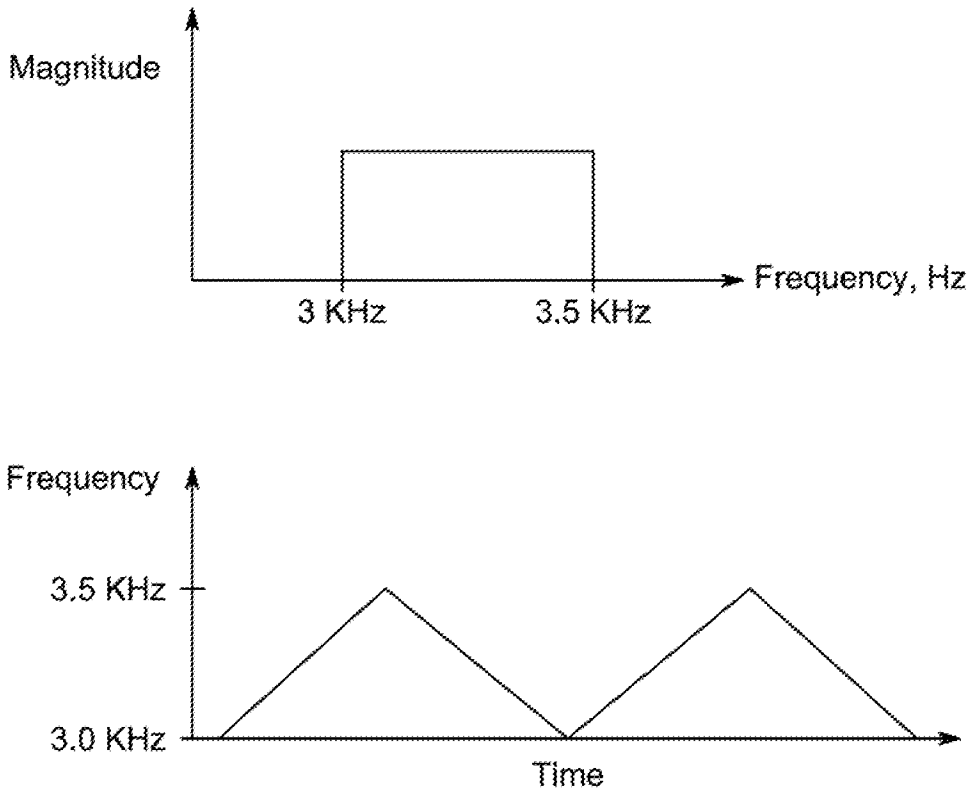

FIG. 6B shows another illustrative frequency modulation scheme provided by control unit 510, according to an embodiment. In particular, FIG. 6B shows the frequency changing as a function of time. As shown, the frequency sweeps from a first frequency (e.g., 3 kHz) to a second frequency (e.g., 3.5 kHz) over a period of time and repeats. The resulting waveform can resemble a triangle waveform.

The frequency modulation driving technique may cause transducer 530 to exhibit a shimmering quality in its sound output. The shimmering quality can be modified by adjusting the shape and rate of the frequency modulation scheme. In addition, the shimmering quality can be used to provide unique buzzer sounds to enhance the user experience. For example, for a first alarm (e.g., smoke alarm), a first frequency modulation scheme may be used, and for a second alarm (e.g., a CO alarm), a second frequency modulation scheme may be used.

It should be appreciated that even though FIG. 6 was described in connection with a piezo-electric buzzer operating somewhere between 3 kHz and 3.5 kHz, frequency modulation schemes discussed herein can be applied to buzzers operating at other frequencies (e.g., 520 Hz). The wave shape and the rate of frequency modulation may be customized for each buzzer. For example, in one embodiment, a transducer may be designed to operate at 520 Hz and between 3-3.5 kHz. For such a transducer, the frequency modulation signal can exhibit a 520 Hz modulation on top of a 3-3.5 kHz modulation signal, thereby resulting in a buzzer that sounds at both frequencies.

Figure 7:
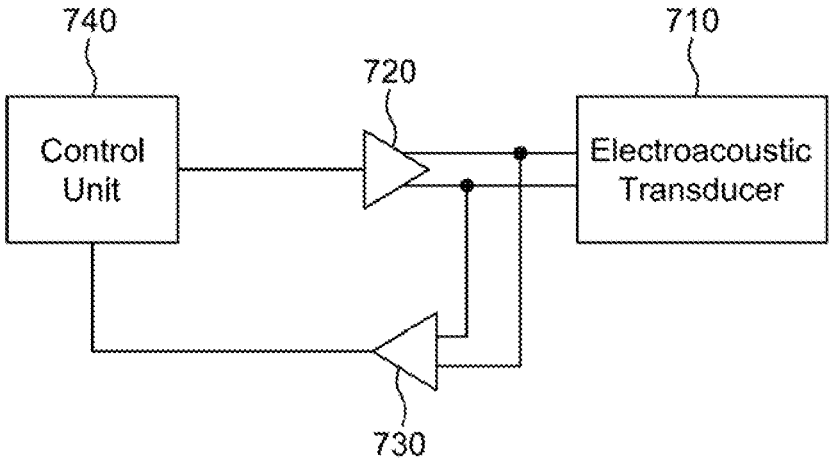
FIG. 7 shows an illustrative block diagram of a closed loop feedback system with electrical sensing in accordance with an embodiment.

FIG. 7 shows an illustrative block diagram of a driver tuning system 700 in accordance with an embodiment. Driver tuning system 700 can include two port electroacoustic transducer 710, driver 720, sense circuitry 730, and control circuitry 740. System 700 is operative to self-adjust the output of driver 720 to maximize output of electroacoustic transducer 710. As shown, driver 720 is coupled to electroacoustic transducer 710, sense circuitry 730 and control circuitry 740, and sense circuitry 730 is coupled to control circuitry 740. During operation, signals such as voltage and/or current can be sensed by sense circuitry 730, and based on these sensed signals, sense circuitry 730 can cause control circuitry 740 to adjust itself so that the output of driver 720 is modified to adjust the magnitude of the electroacoustic transducer output. This can create a real-time feedback loop that enables electroacoustic transducer 710 to be driven to a desired audible magnitude. In effect, the combined operation of driver 720, sense circuitry 730, and control circuitry 740 are operative to maximize audible output of electroacoustic transducer 710 by driving it at maximum resonance, as opposed to preventing an overdrive of the electroacoustic transducer.

Figure 8:
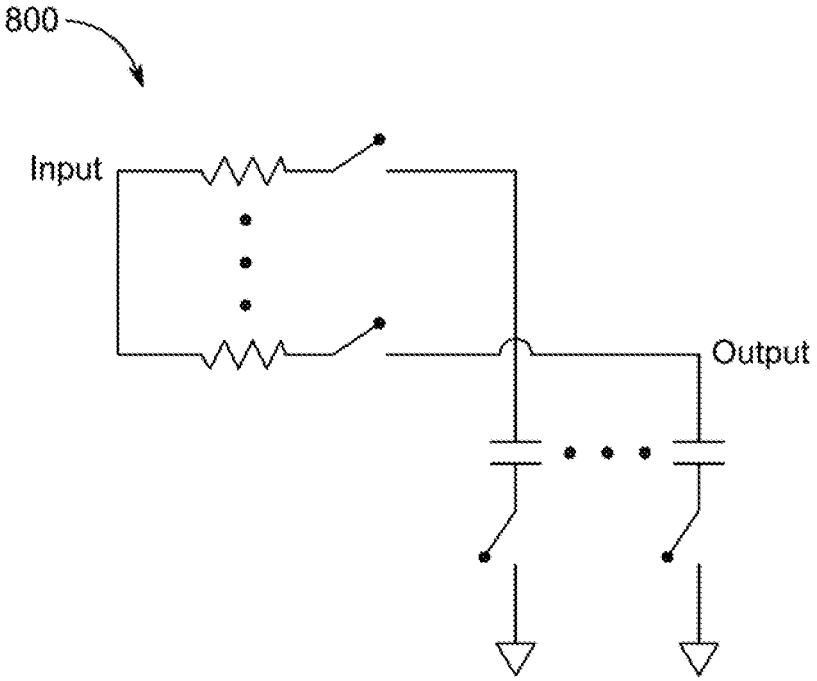
FIG. 8 shows an illustrative schematic diagram of tuning circuitry according to an embodiment.

Control circuitry 740 can be a variable compensation network that can be controlled to change its properties so that the output of driver 720 is changed in response thereto. For example, FIG. 8 shows an illustrative schematic diagram of tuning circuitry 800 according to an embodiment. As shown, tuning circuitry 800 can include an array of resistors and capacitors that each can be individually coupled to a network via a switch. The switches may be turned ON and OFF to achieve a desired network characteristic, the variably controlled characteristics of which can then influence the operation of a driver circuit (e.g., driver circuitry 720). For example, if sense circuitry 730 senses that the feedback power is below a threshold, it can modify tuning circuitry 740 so that output of driver circuitry 720 is changed, thereby changing the output of electroacoustic transducer 710. In some embodiments, electroacoustic transducer 710 may be a three port piezoelectric buzzer. In other embodiments, buzzer 710 may some other type of electroacoustic transducer.

As an alternative use of control circuitry 740, it can be used in lieu of any of the potential compensation networks used in conjunction with device 200 of FIG. 2. This way, once the phase-shift of piezo-electric buzzer 220 is known (e.g., after testing or measurements), the appropriate settings for control circuitry 740 can be selected and permanently fixed throughout operation of device 200. This may enable more customizable compensation circuitry to be used with a particular buzzer, as opposed to a compensation circuit that is selected based on a sample set of buzzers. Control circuitry 740 may be permanently programmed at the factory using a test fixture that monitors the buzzer, or it may be self-programmed using, for example, an on-board microphone (shown in FIG. 9) that is part of device 200.

Figure 9:
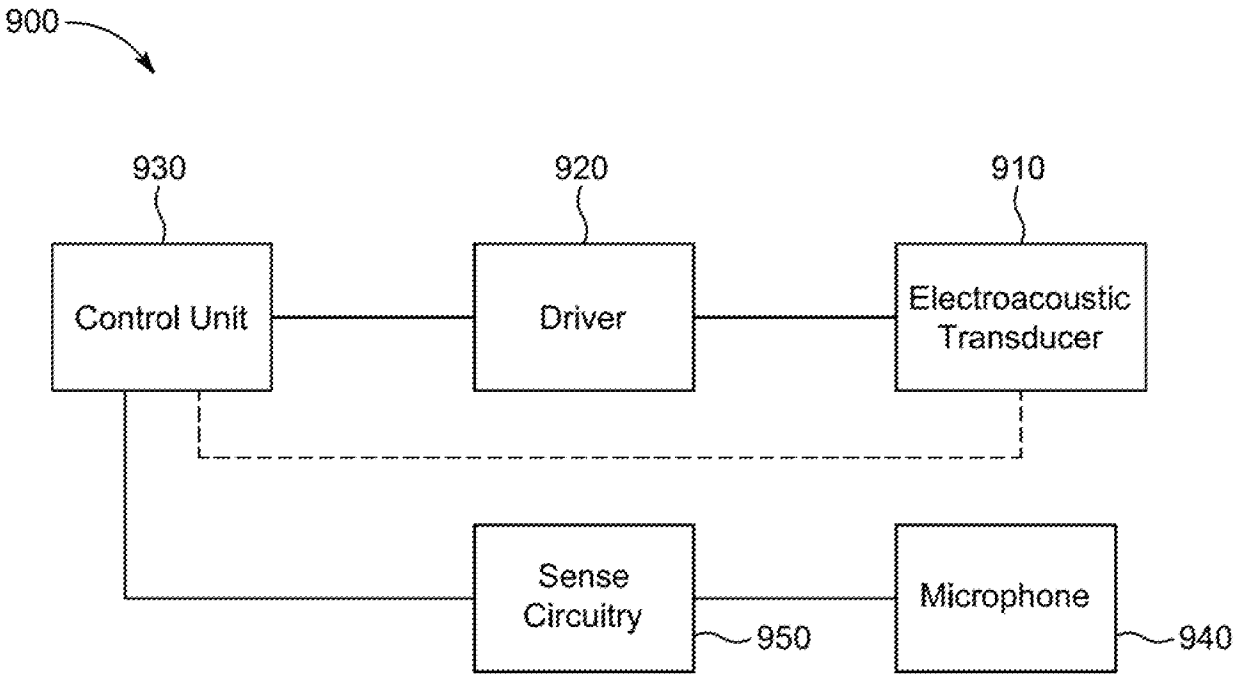
FIG. 9 shows an illustrative schematic diagram of an electroacoustic transducer that uses a microphone according to an embodiment.

FIG. 9 shows an illustrative schematic diagram of buzzer device 900 that uses a microphone according to an embodiment. As shown, device 900 can include electroacoustic transducer 910, driver 920, compensation network 930, microphone 940, and sense circuitry 950. Sounds emitted by the buzzer may be picked up by microphone 940. Buzzer 910 can optionally be coupled to control unit 930 (via the dashed line). Sense circuitry 950 can analyze the sound picked up by microphone 940 and use that analysis to control the output of compensation network 930 (which may be similar to tuning circuitry 800 of FIG. 8). Sense circuitry 950 can continuously send feedback to control unit 930 in real-time, or it can permanently set inputs to control unit 930 after sufficient testing of the buzzer has been completed. In the latter case, buzzer 910 may be coupled to control unit 930. When control unit 930 is configured, it can influence the operation of driver circuit 920 to cause buzzer 910 to generate the appropriate output. In some embodiments, control unit 930 may use a digital or analog synthesis of the driving signal in lieu of the adjustable network. In this embodiment, the control circuit drives the frequency directly.

Figure 10:
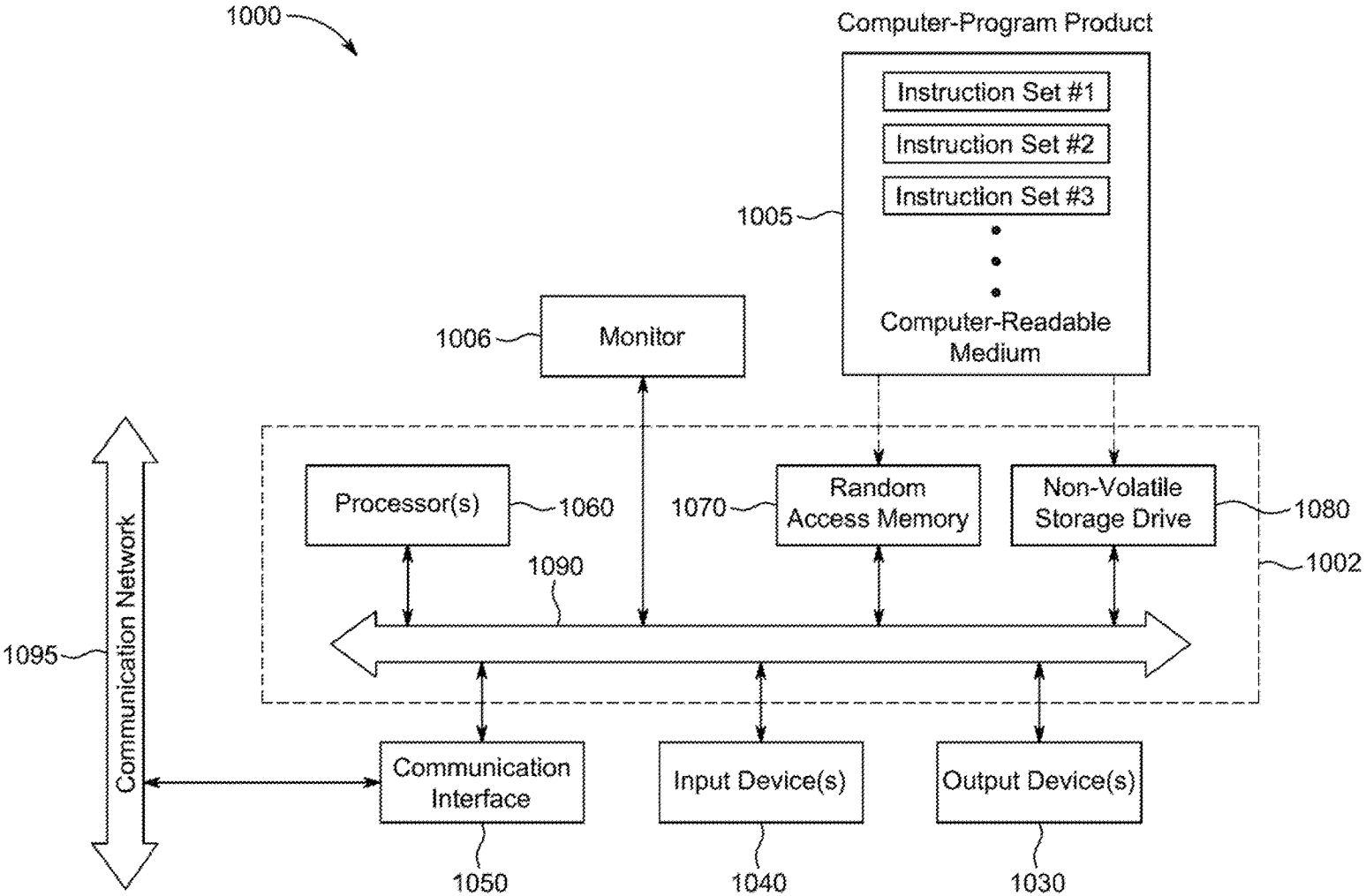
FIG. 10 shows a special-purpose computer system, according to an embodiment.

With reference to FIG. 10, an embodiment of a special-purpose computer system 1000 is shown. For example, one or more intelligent components may be a special-purpose computer system 1000. Such a special-purpose computer system 1000 may be incorporated as part of a hazard detector and/or any of the other computerized devices discussed herein, such as a remote server, smart thermostat, or network. The above methods may be implemented by computer-program products that direct a computer system to perform the actions of the above-described methods and components. Each such computer-program product may comprise sets of instructions (codes) embodied on a computer-readable medium that direct the processor of a computer system to perform corresponding actions. The instructions may be configured to run in sequential order, or in parallel (such as under different processing threads), or in a combination thereof. After loading the computer-program products on a general purpose computer system 1000, it is transformed into the special-purpose computer system 1000.

Special-purpose computer system 1000 can include computer 1002, a monitor 1006 coupled to computer 1002, one or more additional user output devices 1030 (optional) coupled to computer 1002, one or more user input devices 1040 (e.g., keyboard, mouse, track ball, touch screen) coupled to computer 1002, an optional communications interface 1050 coupled to computer 1002, a computer-program product 1005 stored in a tangible computer-readable memory in computer 1002. Computer-program product 1005 directs computer system 1000 to perform the above-described methods. Computer 1002 may include one or more processors 1060 that communicate with a number of peripheral devices via a bus subsystem 1090. These peripheral devices may include user output device(s) 1030, user input device(s) 1040, communications interface 1050, and a storage subsystem, such as random access memory (RAM) 1070 and non-volatile storage drive 1080 (e.g., disk drive, optical drive, solid state drive), which are forms of tangible computer-readable memory.

Computer-program product 1005 may be stored in non-volatile storage drive 1080 or another computer-readable medium accessible to computer 1002 and loaded into random access memory (RAM) 1070. Each processor 1060 may comprise a microprocessor, such as a microprocessor from Intel® or Advanced Micro Devices, Inc.®, or the like. To support computer-program product 1005, the computer 1002 runs an operating system that handles the communications of computer-program product 1005 with the above-noted components, as well as the communications between the above-noted components in support of the computer-program product 1005. Exemplary operating systems include Windows® or the like from Microsoft Corporation, Solaris® from Sun Microsystems, LINUX, UNIX, and the like.

User input devices 1040 include all possible types of devices and mechanisms to input information to computer 1002. These may include a keyboard, a keypad, a mouse, a scanner, a digital drawing pad, a touch screen incorporated into the display, audio input devices such as voice recognition systems, microphones, and other types of input devices. In various embodiments, user input devices 1040 are typically embodied as a computer mouse, a trackball, a track pad, a joystick, wireless remote, a drawing tablet, a voice command system. User input devices 1040 typically allow a user to select objects, icons, text and the like that appear on the monitor 1006 via a command such as a click of a button or the like. User output devices 1030 include all possible types of devices and mechanisms to output information from computer 1002. These may include a display (e.g., monitor 1006), printers, non-visual displays such as audio output devices, etc.

Communications interface 1050 provides an interface to other communication networks, such as communication network 1095, and devices and may serve as an interface to receive data from and transmit data to other systems, WANs and/or the Internet. Embodiments of communications interface 1050 typically include an Ethernet card, a modem (telephone, satellite, cable, ISDN), a (asynchronous) digital subscriber line (DSL) unit, a FireWire® interface, a USB® interface, a wireless network adapter, and the like. For example, communications interface 1050 may be coupled to a computer network, to a FireWire® bus, or the like. In other embodiments, communications interface 1050 may be physically integrated on the motherboard of computer 1002, and/or may be a software program, or the like.

RAM 1070 and non-volatile storage drive 1080 are examples of tangible computer-readable media configured to store data such as computer-program product embodiments of the present invention, including executable computer code, human-readable code, or the like. Other types of tangible computer-readable media include floppy disks, removable hard disks, optical storage media such as CD-ROMs, DVDs, bar codes, semiconductor memories such as flash memories, read-only-memories (ROMs), battery-backed volatile memories, networked storage devices, and the like. RAM 1070 and non-volatile storage drive 1080 may be configured to store the basic programming and data constructs that provide the functionality of various embodiments of the present invention, as described above.

Software instruction sets that provide the functionality of the present invention may be stored in RAM 1070 and non-volatile storage drive 1080. These instruction sets or code may be executed by the processor(s) 1060. RAM 1070 and non-volatile storage drive 1080 may also provide a repository to store data and data structures used in accordance with the present invention. RAM 1070 and non-volatile storage drive 1080 may include a number of memories including a main random access memory (RAM) to store instructions and data during program execution and a read-only memory (ROM) in which fixed instructions are stored. RAM 1070 and non-volatile storage drive 1080 may include a file storage subsystem providing persistent (non-volatile) storage of program and/or data files. RAM 1070 and non-volatile storage drive 1080 may also include removable storage systems, such as removable flash memory.

Bus subsystem 1090 provides a mechanism to allow the various components and subsystems of computer 1002 to communicate with each other as intended. Although bus subsystem 1090 is shown schematically as a single bus, alternative embodiments of the bus subsystem may utilize multiple busses or communication paths within the computer 1002.

It should be noted that the methods, systems, and devices discussed above are intended merely to be examples. It must be stressed that various embodiments may omit, substitute, or add various procedures or components as appropriate. For instance, it should be appreciated that, in alternative embodiments, the methods may be performed in an order different from that described, and that various steps may be added, omitted, or combined. Also, features described with respect to certain embodiments may be combined in various other embodiments. Different aspects and elements of the embodiments may be combined in a similar manner. Also, it should be emphasized that technology evolves and, thus, many of the elements are examples and should not be interpreted to limit the scope of the invention.

Specific details are given in the description to provide a thorough understanding of the embodiments. However, it will be understood by one of ordinary skill in the art that the embodiments may be practiced without these specific details. For example, well-known, processes, structures, and techniques have been shown without unnecessary detail in order to avoid obscuring the embodiments. This description provides example embodiments only, and is not intended to limit the scope, applicability, or configuration of the invention. Rather, the preceding description of the embodiments will provide those skilled in the art with an enabling description for implementing embodiments of the invention. Various changes may be made in the function and arrangement of elements without departing from the spirit and scope of the invention.

It is to be appreciated that while the described methods and systems for intuitive status signaling at opportune times for a hazard detector are particularly advantageous in view of the particular device context, in that hazard detectors represent important life safety devices, in that hazard detectors are likely to be placed in many rooms around the house, in that hazard detectors are likely to be well-positioned for viewing from many places in these rooms, including from near light switches, and in that hazard detectors will usually not have full on-device graphical user interfaces but can be outfitted quite readily with non-graphical but simple, visually appealing on-device user interface elements (e.g., a simple pressable button with shaped on-device lighting), and in further view of power limitations for the case of battery-only hazard detectors making it desirable for status communications using minimal amounts of electrical power, the scope of the present disclosure is not so limited. Rather, the described methods and systems for intuitive status signaling at opportune times are widely applicable to any of a variety of smart-home devices such as those described in relation to FIG. 1 supra and including, but not limited to, thermostats, environmental sensors, motion sensors, occupancy sensors, baby monitors, remote controllers, key fob remote controllers, smart-home hubs, security keypads, biometric access controllers, other security devices, cameras, microphones, speakers, time-of-flight based LED position/motion sensing arrays, doorbells, intercom devices, smart light switches, smart door locks, door sensors, window sensors, generic programmable wireless control buttons, lighting equipment including night lights and mood lighting, smart appliances, entertainment devices, home service robots, garage door openers, door openers, window shade controllers, other mechanical actuation devices, solar power arrays, outdoor pathway lighting, irrigation equipment, lawn care equipment, or other smart home devices. Although widely applicable for any of such smart-home devices, one or more of the described methods and systems become increasingly advantageous when applied in the context of devices that may have more limited on-device user interface capability (e.g., without graphical user interfaces), and/or having power limitations that make it desirable for status communications using minimal amounts of electrical power, while being located in relatively readily-viewable locations and/or well-traveled locations in the home. Having read this disclosure, one having skill in the art could apply the methods and systems of the present invention in the context of one or more of the above-described smart home devices. Also, it is noted that the embodiments may be described as a process that is depicted as a flow diagram or block diagram. Although each may describe the operations as a sequential process, many of the operations can be performed in parallel or concurrently. In addition, the order of the operations may be rearranged. A process may have additional steps not included in the figure.

Any processes described with respect to FIGS. 1-10, as well as any other aspects of the invention, may each be implemented by software, but may also be implemented in hardware, firmware, or any combination of software, hardware, and firmware. They each may also be embodied as machine- or computer-readable code recorded on a machine- or computer-readable medium. The computer-readable medium may be any data storage device that can store data or instructions that can thereafter be read by a computer system. Examples of the computer-readable medium may include, but are not limited to, read-only memory, random-access memory, flash memory, CD-ROMs, DVDs, magnetic tape, and optical data storage devices. The computer-readable medium can also be distributed over network-coupled computer systems so that the computer readable code is stored and executed in a distributed fashion. For example, the computer-readable medium may be communicated from one electronic subsystem or device to another electronic subsystem or device using any suitable communications protocol. The computer-readable medium may embody computer-readable code, instructions, data structures, program modules, or other data in a modulated data signal, such as a carrier wave or other transport mechanism, and may include any information delivery media. A modulated data signal may be a signal that has one or more of its characteristics set or changed in such a manner as to encode information in the signal.

It is to be understood that any or each module or state machine discussed herein may be provided as a software construct, firmware construct, one or more hardware components, or a combination thereof. For example, any one or more of the state machines or modules may be described in the general context of computer-executable instructions, such as program modules, that may be executed by one or more computers or other devices. Generally, a program module may include one or more routines, programs, objects, components, and/or data structures that may perform one or more particular tasks or that may implement one or more particular abstract data types. It is also to be understood that the number, configuration, functionality, and interconnection of the modules or state machines are merely illustrative, and that the number, configuration, functionality, and interconnection of existing modules may be modified or omitted, additional modules may be added, and the interconnection of certain modules may be altered.

Whereas many alterations and modifications of the present invention will no doubt become apparent to a person of ordinary skill in the art after having read the foregoing description, it is to be understood that the particular embodiments shown and described by way of illustration are in no way intended to be considered limiting. Therefore, reference to the details of the preferred embodiments is not intended to limit their scope.

What is claimed is:

1. A device comprising:

an electroacoustic transducer;

driver circuitry coupled to the transducer, the driver circuitry operative to drive operation of the transducer;

control circuitry coupled to the driver circuitry, the control circuitry operative to provide a signal that can vary output of the driver circuitry;

a microphone;

sense circuitry coupled to the control circuitry and the microphone, the sense circuitry operative to:

monitor an output of the microphone; and instruct the control circuitry to change a value of its adjustable network based on the monitored output of the microphone such that the transducer emits an audio signal having at least a minimum magnitude, wherein the transducer is coupled to the control circuitry, and wherein the sense circuitry permanently configures the adjustable network to be used as a phase shift network that supplements a phase of the transducer to enable stable operation of the transducer.

2. The device of claim 1, wherein the sense circuitry instructs the control circuitry in real-time.

3. The device of claim 1, wherein the control circuitry comprises an adjustable network that can vary output of the driver circuitry, and wherein the sense circuitry instructs the control circuitry to change a value of its adjustable network based on the monitored output of the microphone such that the transducer emits an audio signal having a maximum magnitude.

4. The device of claim 1, wherein the value is changed such that the stable operation of the transducer at the at least the minimum magnitude occurs at a resonant frequency of about 520 Hz.

5. The device of claim 1, wherein the value is changed such that the stable operation of the transducer at the at least the minimum magnitude occurs at a resonant frequency of about 3 kHz.

* * * * *